US005353464A

United States Patent [19]

Atkins et al.

[11] Patent Number: 5,353,464

[45] Date of Patent: Oct. 11, 1994

[54] TOOTHBRUSH CONSTRUCTION

[76] Inventors: Marie B. Atkins; Richard Atkins, both of 7070 Goodwood Ave., Baton Rouge, La. 70806

[21] Appl. No.: 2,072

[22] Filed: Jan. 8, 1993

Related U.S. Application Data

[63] Continuation of Ser. No. 640,989, Jan. 14, 1991, abandoned, which is a continuation-in-part of Ser. No. 519,418, May 4, 1990, Pat. No. 5,187,829.

[51] Int. Cl.[5] ..... A46B 9/04

[52] U.S. Cl. ..... 15/167.1; 15/143.1; D4/107; D4/125

[58] Field of Search ..... 15/106, 143.1, 145, 15/160, 167.1, 167.2, 172, 176.1, 176.6; 211/65; 248/110, 111; D4/107, 124–126; D7/656

[56] References Cited

U.S. PATENT DOCUMENTS

| | | | |
|---|---|---|---|
| D. 112,663 | 12/1938 | Partridge | D4/125 |
| D. 128,681 | 8/1941 | Reinold | D4/107 |
| D. 155,669 | 10/1949 | Zandberg et al. | D4/107 |
| D. 209,574 | 12/1967 | Zandberg et al. . | |
| D. 237,659 | 11/1975 | Meyer et al. | D4/107 |
| D. 242,507 | 11/1976 | Cohen et al. | D4/125 |
| D. 274,971 | 8/1984 | Kelley et al. | D7/656 |
| D. 294,391 | 2/1988 | Woo | D7/656 |
| 2,511,235 | 6/1950 | Arwood | 15/106 |
| 2,539,035 | 1/1951 | Scanlon et al. | 248/110 |
| 2,921,326 | 1/1960 | Lautmann | 15/167.1 |
| 4,283,808 | 8/1981 | Beebe | 15/167.1 |
| 4,558,483 | 12/1985 | Noser | 15/167.1 |
| 4,592,109 | 6/1986 | Borea et al. | 15/172 |

FOREIGN PATENT DOCUMENTS

| | | | |
|---|---|---|---|
| 641155 | 1/1937 | Fed. Rep. of Germany | 15/160 |
| 676304 | 7/1952 | Fed. Rep. of Germany | 15/143 R |
| 180027 | 12/1935 | Switzerland | 15/143 R |

*Primary Examiner*—David A. Scherbel
*Assistant Examiner*—Mark Spisich
*Attorney, Agent, or Firm*—John F. Sieberth

[57] ABSTRACT

The handle of the toothbrush is in the general form of an animal (e.g., a quadriped) having its body-supported when not in use in a generally horizontal position. The handle is manually encircled and grasped by the hand with the thumb extending under and around the lower part of the body and with the palm and fingers extending over and around the upper part of the body portion as in a fist. The brush head of the toothbrush extends from an end of the handle. When the brush is not in use, it is adapted to rest on a flat surface with the bristles spaced from such surface. The device is adapted to motivate children to acquire and maintain desirable lifelong habits of good dental hygiene, it is easy for children to use, and it has enhanced sanitary features not found in the common types of toothbrushes presently available in the marketplace. To enhance the utility of the construction, at least an exterior portion of that part of the body portion which is manually encircled and grasped by the the user's hand as in a fist, is fabricated from a cellular material, preferably a closed cell cellular polymer which, most preferably, has a relatively smooth outer finish and is manually compressible but resilient. A preferred cellular polymer is a closed cell foamed or cellular ethylene-vinyl acetate copolymer.

20 Claims, 10 Drawing Sheets

FIG. 15
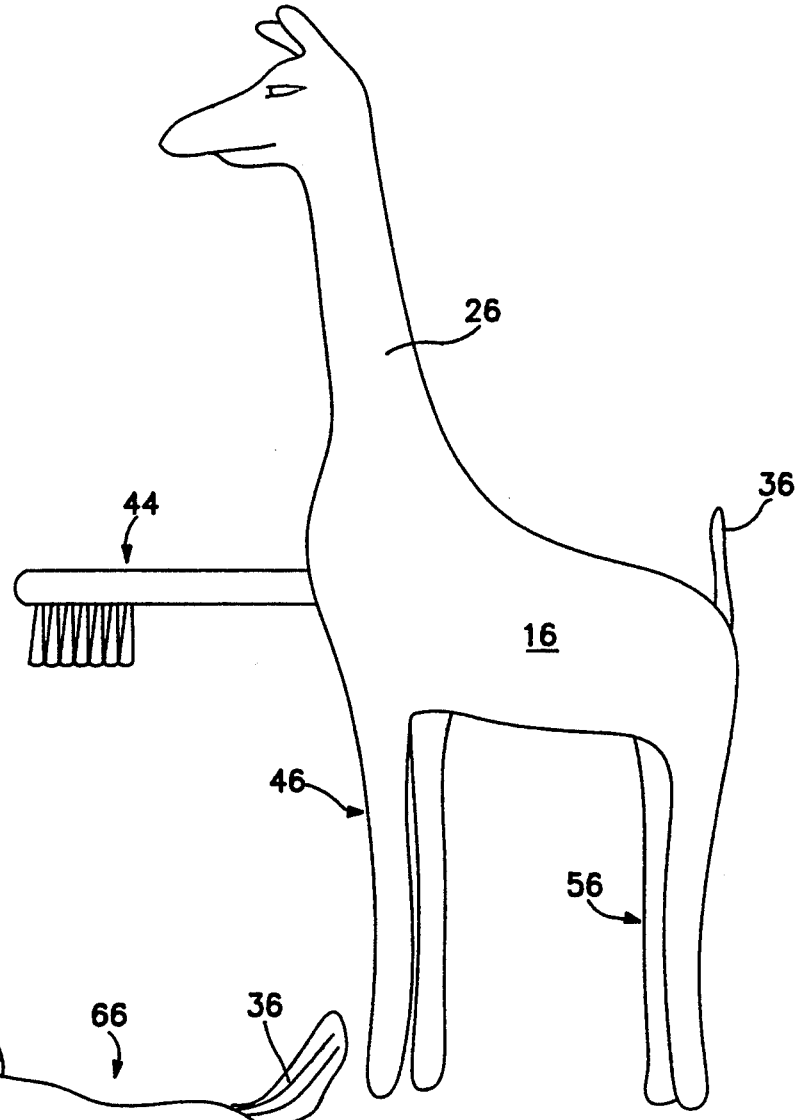
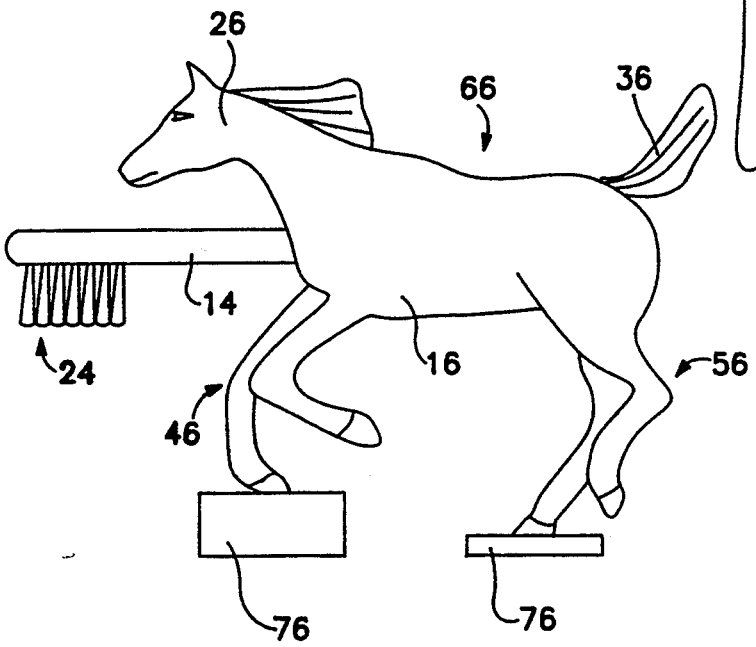
FIG. 16

TOOTHBRUSH CONSTRUCTION

REFERENCE TO RELATED APPLICATION

This is a continuation of copending application(s) Ser. No. 07/640,989 filed on Jan. 14, 1991, abandoned, which is a continuation-in-part of prior copending application Ser. No. 519,418 filed May 4, 1990. U.S. Pat. No. 5,187,829.

TECHNICAL FIELD

This invention relates to improved toothbrush constructions of enhanced utility.

THE INVENTION

In accordance with this invention a toothbrush construction is provided which possesses a combination of functional and psychological advantages heretofore unavailable in the art. More particularly, this invention provides a toothbrush construction that is especially adapted to motivate children to acquire and maintain desirable lifelong habits of good dental hygiene. At the same time the toothbrush is exceptionally easy for children to use and this, in turn, reinforces its motivational aspects. And in addition to the foregoing combination of features, this invention provides a toothbrush construction having enhanced sanitary features not found in the common types of toothbrushes generally available in the present day marketplace.

Besides being of particular utility for children, the toothbrushes of this invention are especially suitable for use by handicapped persons, particularly persons deficient in manual dexterity.

The above and other advantages of this invention are achieved by providing a toothbrush construction which comprises:

(a) a handle portion; and (b) a brush head portion having bristles extending at an angle therefrom, said toothbrush construction being further characterized in that:

(c) said handle portion is in the general form of (i.e., it is in a form simulating) an animal (preferably a quadrupedal animal) and includes (i) a generally horizontal body (trunk) portion—and more preferably, a substantially horizontal body body (trunk) portion—adapted to be manually encircled and grasped by the hand with the thumb extending under and around the lower part of the body portion and with the palm and fingers extending over and around the upper part of the body portion as in a fist, (ii) a head/neck portion attached to said body portion, (iii) a front leg portion attached to said body portion, (iv) a rear leg portion attached to said body portion, and (v) optionally, but preferably, a tail portion attached to said body portion;

(d) at least one of (ii) and (iii) extends outwardly more or less transversely relative to said body portion to form a first restraining member, and at least one of (iv) and (v) extends outwardly more or less transversely relative to said body portion to form a second restraining member spaced apart from the first restraining member;

(e) said restraining members are disposed on said handle portion such that when said body portion is grasped as in a fist as hereinbefore described, one of said restraining members is adapted to be proximate or adjacent to the thumb and forefinger side of the hand of the user and the other of said restraining members is adapted to be proximate or adjacent to the fourth finger side of the hand of the user;

(f) said brush head portion includes a stem portion which extends substantially longitudinally from an end of said handle portion; and (g) a portion of said handle portion is adapted to support the toothbrush, when not in use, on a flat supporting surface with the bristles of said brush head portion spaced from such supporting surface.

It will be seen, therefore, that when the brush is in use, (1) the handle portion is grasped around the body or trunk portion of the animal, (2) either a front leg portion or the head/neck portion, or the combination of both, serves as a lateral restraint for one edge of the clenched hand of the user, and (3) either a rear leg portion or the tail portion (if present), or the combination of both, serves as a lateral restraint for the other edge of the clenched hand of the user.

By "generally horizontal" or "generally horizontally" is meant that the longitudinal axis of the body portion of the handle portion is either horizontal or is inclined from the horizontal by up to about 60 degrees. By "substantially horizontal" or "substantially horizontally" is meant that the longitudinal axis of the body portion of the handle portion is either horizontal or is inclined from the horizontal by up to about 15 degrees. It will be understood that the word "trunk" is used to denote the major portion of the body or torso of the animal, not the trunk of an elephant.

Preferably, the brush head stem extends substantially longitudinally from the forward body portion of the animal (i.e., the brush head stem extends from the front of the animal's body more or less in parallel with the longitudinal axis of the body). In this case, when the handle portion is grasped by the user's right hand around the body or trunk portion of the animal from the left side of the animal's body (or by the user's left hand grasping the animal's body from the right side of the animal's body), either a front leg portion or the head/neck portion, or the combination of both, serves as a lateral restraint for the thumb-forefinger edge or side of the clenched hand of the user, and either a rear leg portion or the tail portion (if present), or the combination of both, serves as a lateral restraint for the fourth finger edge or side of the clenched hand the user. However, the brush head stem can extend from the rearward portion of the body portion, and in this case, when the handle portion is grasped by the user's right hand around the body or trunk portion of the animal from the right side of the body (or by the user's left hand grasping the animal's body from the left side of the animal's body), either a rear leg portion or the tail portion (if present), or the combination of both, serves as a lateral restraint for the thumb-forefinger edge or side of the clenched hand of the user, and either a front leg portion or the head/neck portion, or the combination of both, serves as a lateral restraint for the fourth finger edge or side of the clenched hand of the user. Thus the user's grip is made much more secure, and the possibility of the user's clenched hand coming in contact with the brush head is greatly reduced.

If desired, the device can be equipped with two brush head portions, the stem of one extending substantially longitudinally from the forward body portion of the animal and the stem of the other brush head portion extending substantially longitudinally from the rearward body portion of the animal.

As noted above, a portion of the handle portion is adapted to support the toothbrush, when not in use, on a flat supporting surface with the bristles of the brush head portion spaced from such supporting surface. For best results, the stem of the brush head portion should extend or project substantially horizontally (as herein defined) from the handle portion, and in addition, should project forwardly and/or rearwardly from the body portion of the animal configuration constituting the handle portion. In this way the bristles are not only kept from any contact with the underlying supporting surface when the brush is not in use, but in addition the user of the brush tends to be more tempted or induced to grasp the handle portion around the body portion rather than reaching for the brush head portion. These features in turn promote better sanitary conditions than often exist with conventional toothbrushes which are often grasped by the brush head in order to remove them from the brush holders which usually position the brush in a substantially upright or vertical position. And when such brush holders are configured in the form of slotted or apertured supports through which the handle of the conventional toothbrush is placed, the back portion of the bristles of the brush head actually rest on such support and this in itself can be an unsanitary condition.

The animal embodied in the handle portion can be configured in a prone position whereby the body of the animal and/or its folded limbs can serve as the portion of the handle adapted to support the toothbrush, when not in use, on a flat supporting surface with the bristles of the brush head portion spaced from such supporting surface. In such a case, the handle portion should include an outwardly (i.e., substantially transversely) extending head/neck portion and an outwardly (i.e., substantially transversely) extending tail portion to serve as the restraints for the thumb-forefinger and fourth finger edges or sides of the hand of the user.

In a preferred embodiment of this invention, the animal embodied in the construction of the handle portion is a quadrupedal animal such that the front leg portion consists of two legs and the rear leg portion consists of two legs. Most preferably, the quadrupedal animal is configured in a standing (or running) position with all four such legs extending in a generally downward direction relative to the body of the animal to thereby serve as the portion of the handle adapted to support the toothbrush, when not in use, on a flat supporting surface with the bristles of said brush head portion spaced from such supporting surface. By causing the leg portions to extend downwardly from the body or trunk of the quadrupedal animal, a space is provided between the body or trunk and the underlying supporting surface thereby making it very easy to grasp the handle portion around the body or trunk of the animal. In other words, a space is provided between the lower part of the body of the simulated animal and the underlying supporting surface, which space is at least large enough for the user to insert the thumb into this space with the fingers of the same hand extending over and around the upper part of the body. Preferably, the space between the underlying supporting surface and the lower part of the simulated animal is at least about 30 millimeters (mm) high, more preferably in the range of about 35 to about 55 mm, and most preferably in the range of about 45 to about 55 mm. And preferably, the front-to-back distance between the downwardly extending front leg portion and the downwardly extending rear leg portion (as measured horizontally below, but in the vicinity of, the lower part of the simulated animal) is at least about 55 mm, more preferably in the range of about 55 to about 90 mm, and most preferably in the range of about 75 to about 90 mm. On closing the hand as in a fist the body of the simulated animal can be readily encircled in the positive grasp of the user. Fingertip control and mature manual dexterity are thus not required for effecting a secure grip on the body portion of the handle. Thus in these preferred embodiments the leg portions serve both as supports for the overall device when not in use and as lateral restraining or support members on both sides or edges of the hand of the user when the device is in use.

Most preferably, the body portion of the simulated quadrupedal animal is substantially horizontal (as herein defined) when the toothbrush construction is disposed on an underlying horizontal surface and supported in this manner by the downwardly extending leg portions of the simulated quadrupedal animal. This greatly facilitates the grasping of the body portion of the handle, as the user need not rotate the arm and hand to a significantly angular position in order to effect the grasp of the handle—a natural, substantially horizontal thrust of a child's hand and arm toward an attractive object is thus matched by the substantially horizontal disposition of the body portion of the handle. In short, the positioning of the body portion in a substantially horizontal position when on a horizontal supporting surface further minimizes the amount of hand and eye coordination required to grasp and remove the toothbrush construction from its resting position. And by providing a spatial zone under the lower part of the body portion of the simulated animal between the downwardly extending front and back legs of the simulated animal, this positive grasp is facilitated even more. It will also be seen that by disposing the brush head portion so that its stem extends substantially longitudinally from front or rear of the substantially horizontal body portion of the simulated animal, the brush head is spaced remotely from the underlying supporting surface, for example by at least the approximate length of the leg portions of the simulated animal. This in turn tends to reduce the possibility of the brush head coming in contact with the supporting surface when the toothbrush is being picked up.

Preferably, the brush head is at least about 35 mm, more preferably in the range of about 40 to about 75 mm, and most preferably in the range of about 50 to about 75 mm, above the underlying supporting surface when the toothbrush construction is disposed thereon and supported by means of the front leg portion and the rear leg portion of the handle portion.

Thus in this preferred embodiment wherein the handle portion of the toothbrush construction simulates a quadrupedal animal with the body portion of the animal in a substantially horizontal position, and with the four legs extending downwardly to provide a substantial spatial area under the lower portion of the body of the simulated animal in between the front leg portion and the back leg portion, and with the brush head stem extending longitudinally from the forward and/or rearward body portion of the animal, the natural body features of the simulated animal are not only embodied in the toothbrush construction but are converted into utilitarian features of the toothbrush construction. The substantially horizontal body portion serves as an easily grasped and held handle. The leg portions (a) provide support for the entire construction when not in use, (b) elevate the handle and maintain the body portion in such substantially horizontal position to facilitate the grasping and removal of the entire construction from the supporting surface, (c) elevate the brush head so that it is remote from the supporting surface and thus unlikely to come in contact with that surface when the entire construction is picked up, and (d) serve as restraining members which extend downwardly from the body far enough to prevent the hand of the user from sliding over the restraining members while the hand of the user encircles and grasps the body portion of the simulated animal between the restraining members with the thumb of the user's hand extending under and around the lower part of the body portion and the user's palm and fingers extending over and around the upper part of the body portion of the simulated animal, as in a fist. By further including on the simulated animal a head/neck portion outwardly extending at an angle from the body portion, and a tail portion outwardly extending at an angle from the body portion, these additional natural features of the simulated animal are also converted into utilitarian features of the construction, as they serve as additional restraints for the thumb-forefinger and fourth finger edges or sides of the hand of the user.

Additionally, the simulated animal itself serves to motivate small children to make use of the toothbrush, as the overall construction is easy to use and serves in much the same way as an attractive small toy.

It is possible, though less preferred, to have one or even two of the legs of the animal raised from the supporting surface. In this case is desirable to provide a suitably large base below the legs that do rest upon the supporting surface so that when the brush is not in use the overall device is supported by the base with the bristles of said brush head portion remotely spaced from such supporting surface, and preferably with the brush head stem disposed in a substantially horizontal position (as herein defined).

It is also preferred to position the brush head such that when the handle portion is grasped as in a fist as described above, and with the bristles extending toward the user in a tooth brushing position, none of the handle portion (including the leg portions, the head/neck portion, and the tail portion) is close enough to the user to interfere with the tooth brushing motion.

The brush head stem portion can be permanently attached or secured to the handle portion, or the brush head stem portion can be detachably attached or secured to the handle portion. In the latter case the brush head stem can be suitably grooved or otherwise shaped around its perimeter (e.g., as an octagon, a decagon, or etc.) so that it can be fitted tightly as with a snap fit into a matching recess within the handle portion and in a number of different angular orientations so that the orientation of the brush head and bristles can be altered to an optimum position for use by the particular user. In short the angular orientation of the brush head stem in the recess is, in this case, adjustable by the user.

Pursuant to a particularly preferred embodiment of this invention there is provided a toothbrush construction which comprises:

(a) a handle portion; and (b) a brush head portion having bristles extending at an angle therefrom, said toothbrush construction being further characterized in that:

(c) said handle portion is in the general form of (i.e., it simulates) a quadrupedal animal and includes (i) a generally horizontal body (trunk) portion adapted to be manually encircled and grasped by the hand with the thumb extending under and around the lower part of the body portion and with the palm and fingers extending over and around the upper part of the body portion as in a fist, (ii) a head/neck portion attached to said body portion with at least a portion of said head/neck portion extending generally upwardly relative to said body portion, (iii) a front leg portion consisting of a pair of legs attached to said body portion with at least a portion of said pair of legs extending generally downwardly relative to said body portion, (iv) rear leg portion consisting of a pair of legs attached to said body portion with at least a portion of said pair of legs extending generally downwardly relative to said body portion, and (v) a tail portion attached to said body portion with at least a portion of said tail portion extending generally upwardly relative to said body portion;

(d) said head/neck portion and said front leg portion are disposed on said handle portion such that when said body portion is grasped as in a fist as hereinbefore described, at least part of said head/neck portion and at least part of said front leg portion are adapted to abut or be proximate either to the thumb and forefinger side of the hand of the user or to the fourth finger side of the hand of the user;

(e) said tail portion and said rear leg portion are disposed on said handle portion such that when said body portion is grasped as in a fist as hereinbefore described, at least part of said tail portion and at least part of said rear leg portion are adapted to abut or be proximate either to the thumb and forefinger side of the hand of the user or to the fourth finger side of the hand of the user, whichever is not abutted by or proximate to at least part of said head/neck portion and at least part of said front leg portion;

(f) said brush head portion includes a stem portion which extends substantially longitudinally from an end of said handle portion; and (g) said front leg portion and said rear leg portion are adapted to support the toothbrush, when not in use, on a flat supporting surface with the bristles of said brush head portion remotely spaced from such supporting surface.

It can thus be seen that the head/neck portion and the front leg portion of this construction serve as first restraining means, and that the tail portion and the rear leg portion of this construction serve as second restraining means. In this construction it is particularly preferred to space the body portion from the flat supporting surface by a sufficient distance to enable the hand of the user to encircle and grasp the body portion between such first and second restraining means with the thumb of the user extending over and around the upper part of the body portion of the simulated animal and with the palm and fingers of the user extending over and around the upper part of the body portion of the simulated animal. Such spacing can, as noted above, best be effected by extending the leg portions of the animal downwardly in either a standing or running position so that the body is remotely spaced from the underlying supporting surface when the toothbrush construction is not in use.

In the various embodiments of this invention referred to above, it is highly desirable to fabricate at least that part of the body portion of the simulated animal that is adapted to be grasped as aforesaid, and most preferably all of the simulated animal parts (body portion, head/-neck portion, front leg portion, rear leg portion, and (when present) tail portion), from a relatively rigid, slightly compressible foam or cellular material, preferably a closed cell plastic foam such as foamed EVA (ethylene-vinyl acetate), or like material. Closed cell foams or cellular materials contain cells or voids that are discrete so that the gas phase within a cell is independent of that of the other cells. Preferred cellular or foamed materials are characterized by having a relatively firm and relatively smooth or textured outer finish (e.g., to simulate an animal's skin or hide), by being manually compressible or squeezable but resilient, and by being pleasant to the touch. Thus even when wet such materials provide the basis for a firm grip with little or no slippage. But at the same time, such materials retain their initial shape and configuration even after long periods of repetitive usage. Moreover, foams or cellular materials of this type can readily be colored so that the simulated animals can be provided in a variety of colors to further enhance their attractiveness.

The technology for producing foamed plastics (also known as cellular polymers, expanded plastics, and plastic foams) is known and reported in the literature. See in this connection such sources as Kirk-Othmer, *Encyclopedia of Chemical Technology*, Wiley-Interscience, Volume 11, pages 82–126, Copyright, 1980, and references cited therein. All disclosures of such pages 82–126 and such cited references are incorporated herein by reference.

The foregoing and other aspects, embodiments and features of this invention will be still further apparent from the ensuing description, appended claims and accompanying Drawings.

THE DRAWINGS

In the Drawings, in which like numerals represent like functional parts among the several embodiments depicted:

FIG. 15 is a side view of a typical toothbrush of this invention in which the animal is a giraffe;

FIG. 16 is a side view of a typical toothbrush of this invention in which the animal is a horse;

FURTHER DESCRIPTION

Figure 6:
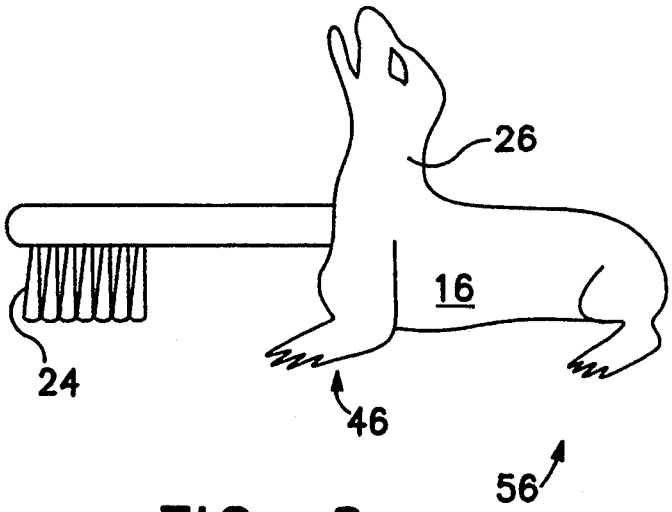
FIG. 6 is a side view of a typical toothbrush of this invention in which the animal is a seal.
Figure 7:
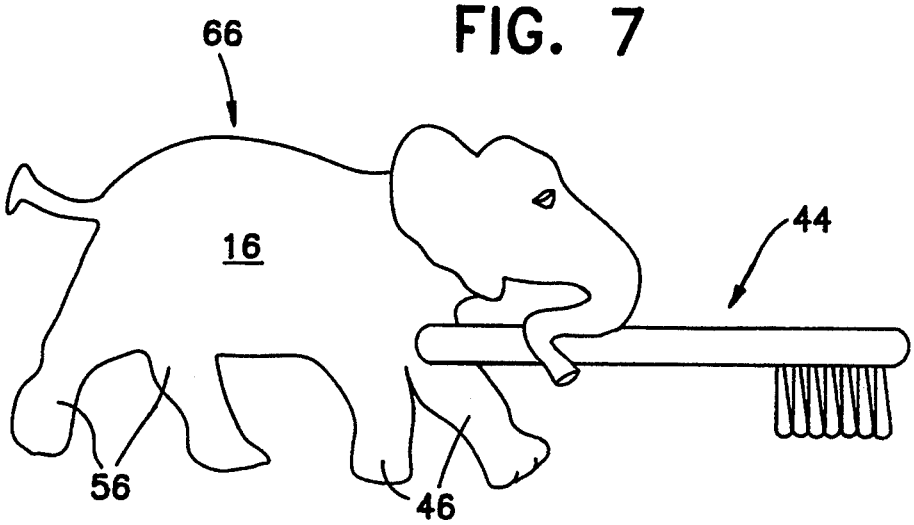
FIG. 7 is a side view of a typical toothbrush of this invention in which the animal is an elephant.
Figure 8:
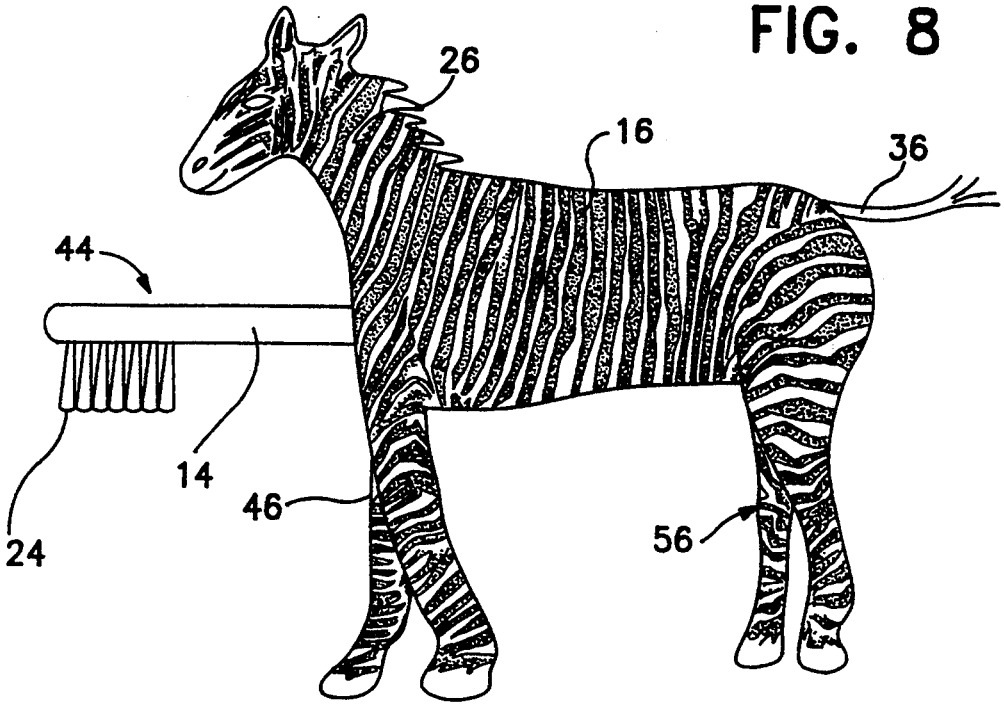
FIG. 8 is a side view of a typical toothbrush of this invention in which the animal is a zebra.
Figure 9:
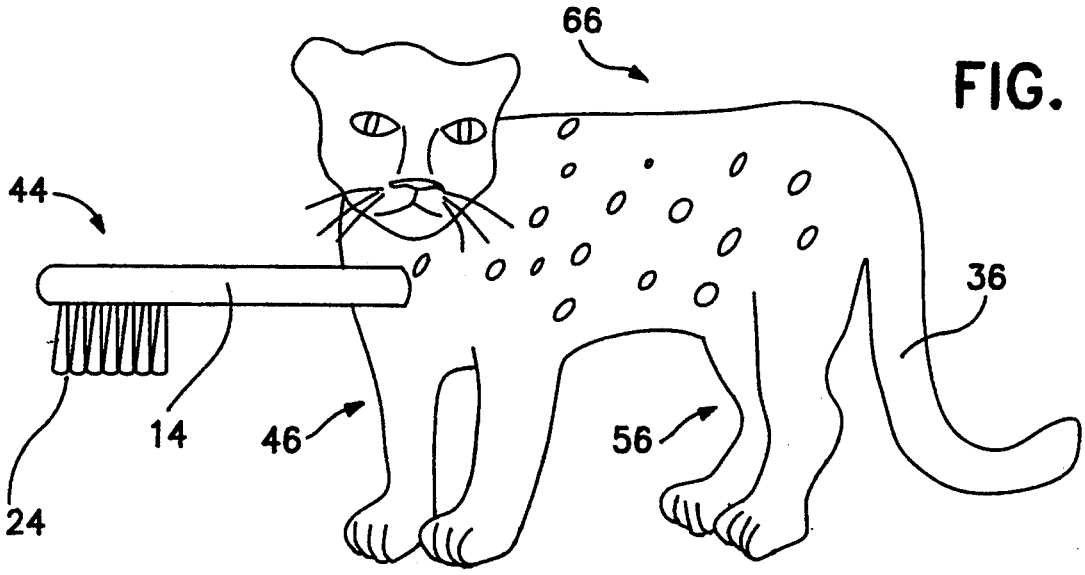
FIG. 9 is a side view of a typical toothbrush of this invention in which the animal is a jaguar.
Figure 17:
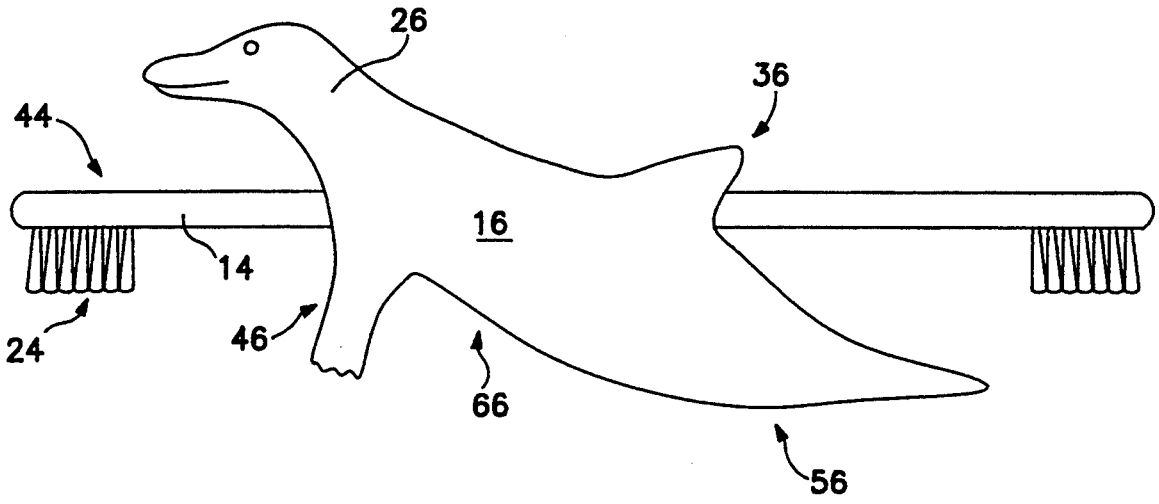
FIG. 17 is a side view of a typical toothbrush of this invention in which the animal is a dolphin.

It will be appreciated that the animal utilized in the design of the toothbrush need not be a land animal—it can be a fish or other underwater creature such as a squid or octopus, wherein fins, tentacles, claws or other body appendages serve as the leg and/or tail portions of the handle portion of the toothbrush construction. The seal and the dolphin utilized in the constructions depicted in FIGS. 6 and 17 illustrate such variant. It will also be appreciated that various other animals having a neck portion, leg portions and preferably a tail portion (or their equivalent) can be utilized in the design and construction of the toothbrushes of this invention, the forms depicted in the drawings being but exemplifications of some of the numerous types of animals that can be so utilized. It will also be appreciated that the form, shape, appearance and size of given animals can be stylized, distorted and/or exaggerated to achieve desired visual effects and to suitably arrange and position the functional elements of the device in the proper locations. Thus, for example, the animals can be given humanesque features and/or facial expressions to achieve humorous and/or other appealing characteristics, and the shapes or body portions of the animals can be elongated, shortened, widened, narrowed, etc, as needed to provide the proper hand gripping surface, the proper hand restraining members, the proper underlying support for the brush when not in use, and the proper support section for the brush head.

Among suitable quadrupeds are the following animals: alligator, badger, bear, beaver, buffalo, bull, camel, caribou, cat, cheetah, cow, coyote, crocodile, deer, dog, donkey, elephant, elk, fox, giraffe, goat, hamster, hog, horse, iguana, impala, jaguar, koala, kudu, lemming, lemur, leopard, lion, llama, mongoose, moose, mountain lion, mouse, nutria, otter, ox, panther, pig, platypus, rabbit, raccoon, reindeer, rhinoceros, sheep, shrew, skunk, squirrel, steer, Tasmanian devil, tiger, wapiti, weasel, wolf, wolverine, yak, zebra, and the like, including diminutive forms such as calf, colt, cub, kitten, lamb, pony, puppy, and so on. Also readily utilizable in the practice of this invention are tailed animals having four limbs such as baboons, kangaroos, monkeys, wallabies, and the like. The animals used in designing the handle portion of the toothbrushes of this invention can also comprise prehistoric or extinct animals or reptiles such as the numerous species making up the families of dinosaurs, including for example, brontosaurus, stegosaurus, triceratops, and tyrannosaurus rex, among many others. Use may also be made of land, sea or air creatures having bodily characteristics (fins, tail, wings, etc.) which can be utilized (in exaggerated form when necessary) as restraining members for either side of the clenched hand grasping the handle portion. A few such suitable or amenable creatures include dolphins, pterodactyls, sharks, turtles, threshers, walrus, whales, and many others.

In turning our attention now to the Drawings, it should be kept in mind that the Figures are presented in simple, substantially schematic form to illustrate the principles of this invention.

As can be seen from the Drawings, the toothbrush constructions in the forms depicted comprise a handle portion 66 and a brush head portion 44. Handle portion 66 comprises a body portion 16 of an animal, a head/-neck portion 26 of the animal, a tail portion 36 of the animal, a front leg portion 46 of the animal, and a rear leg portion 56 of the animal. The front leg portion 46 and the rear leg portion 56 are each usually (but not necessarily) composed of two laterally disposed limbs or their equivalent such as fins or flippers (note FIGS. 6 and 17). Brush head portion 44 comprises stem 14 and a plurality of bristles 24 (usually but not necessarily arranged in tufts) extending from the head end portion of stem 14 (usually but not necessarily extending at right angles from the stem). The plurality of bristles 24 form the brush for cleaning the teeth.

In use, the device in the form depicted is manually grasped around body portion 16 with the thumb extending under and around the underside of body portion 16 close to or immediately adjacent the back sides of front leg portion 46 and with the palm and four fingers (considered collectively) extending over and around the upper side of body portion 16. When so-grasped, as in a fist, head/neck portion 26 abuts or is close to the index finger side of the hand, whereas tail portion 36 and rear leg portion 56 abut or are close to the fourth finger side of the hand. Thus, front leg portion 46, head/neck portion 26, tail portion 36 and rear leg portion 56 mutually cooperate to restrain, or at least restrict or confine, lateral movement or slippage of the hand either toward or away from brush head portion 44.

It will be seen that stem 14 positions the brush composed of bristles 24 sufficiently remote from the outwardly projecting parts of handle portion 66 (i.e., head/neck portion 26, tail portion 36, front leg portion 46 and rear leg portion 56) such that such outwardly projecting parts do not and cannot interfere with the brushing action.

Figure 1:
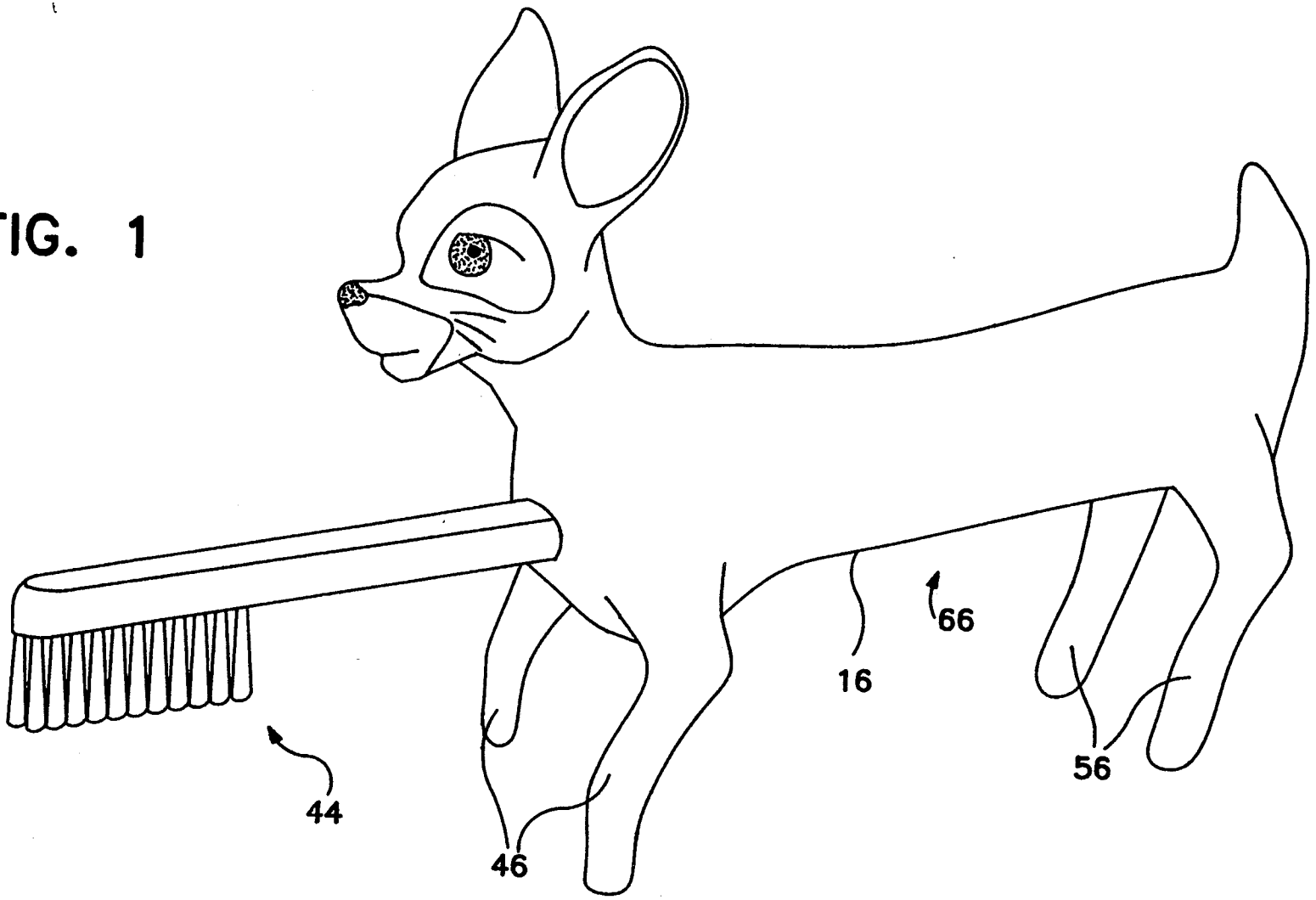
FIG. 1 is a view in perspective of a typical toothbrush of this invention in which the animal is a deer.
Figure 2:
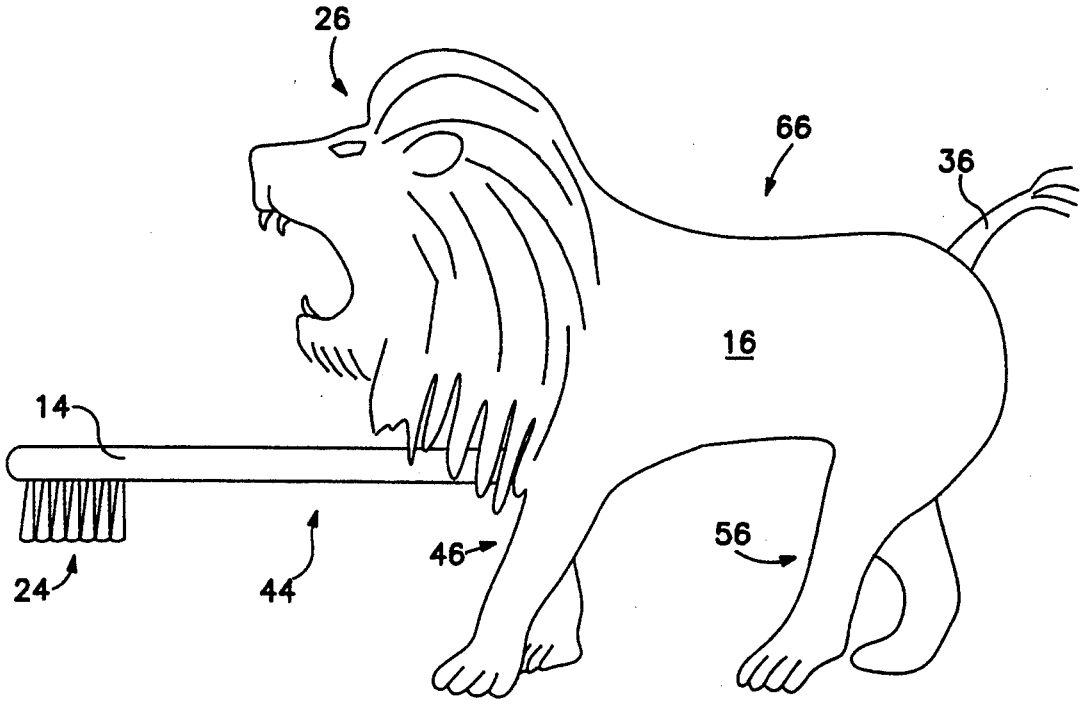
FIG. 2 is a side view of a typical toothbrush of this invention in which the animal is a lion.
Figure 3:
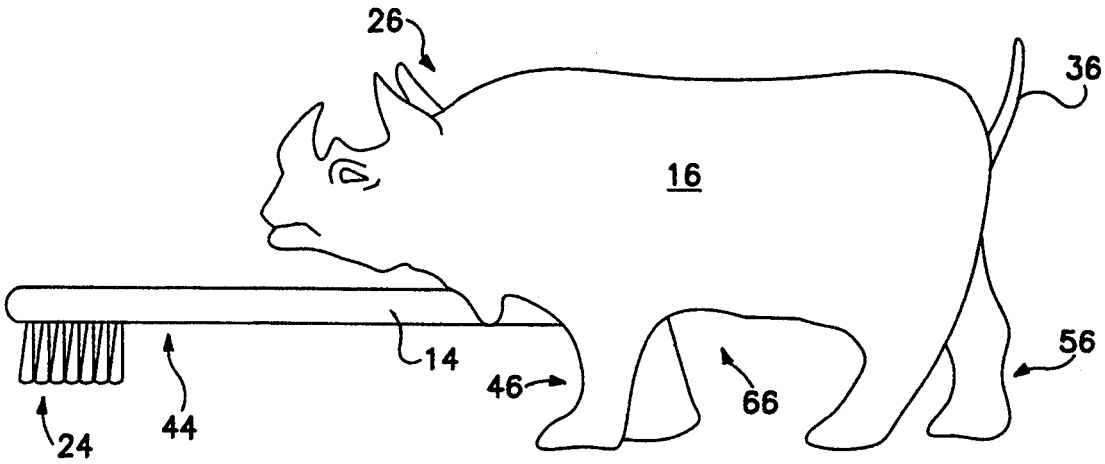
FIG. 3 is a side view of a typical toothbrush of this invention in which the animal is a rhinoceros.
Figure 4:
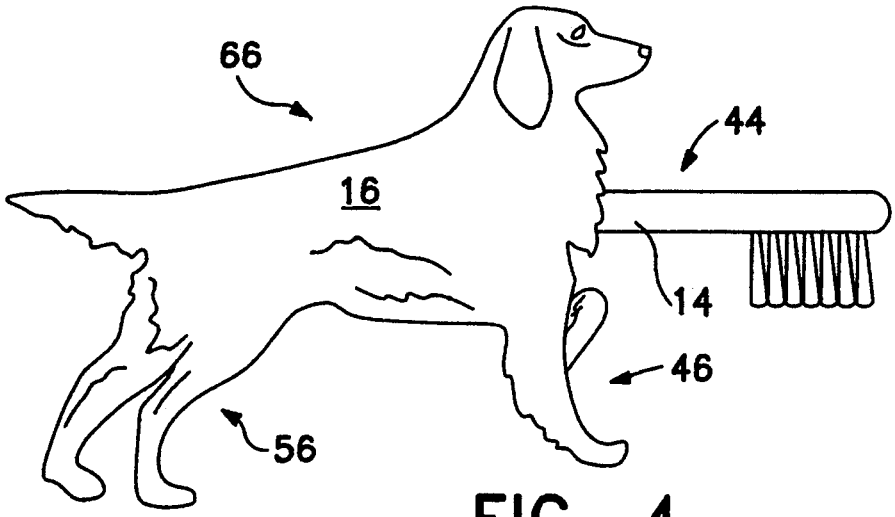
FIG. 4 is a side view of a typical toothbrush of this invention in which the animal is a dog.
Figure 5:
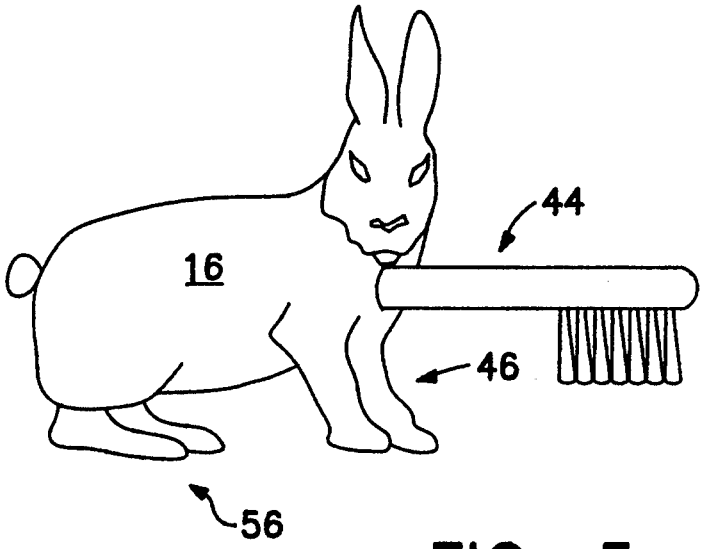
FIG. 5 is a side view of a typical toothbrush of this invention in which the animal is a rabbit.
Figure 10:
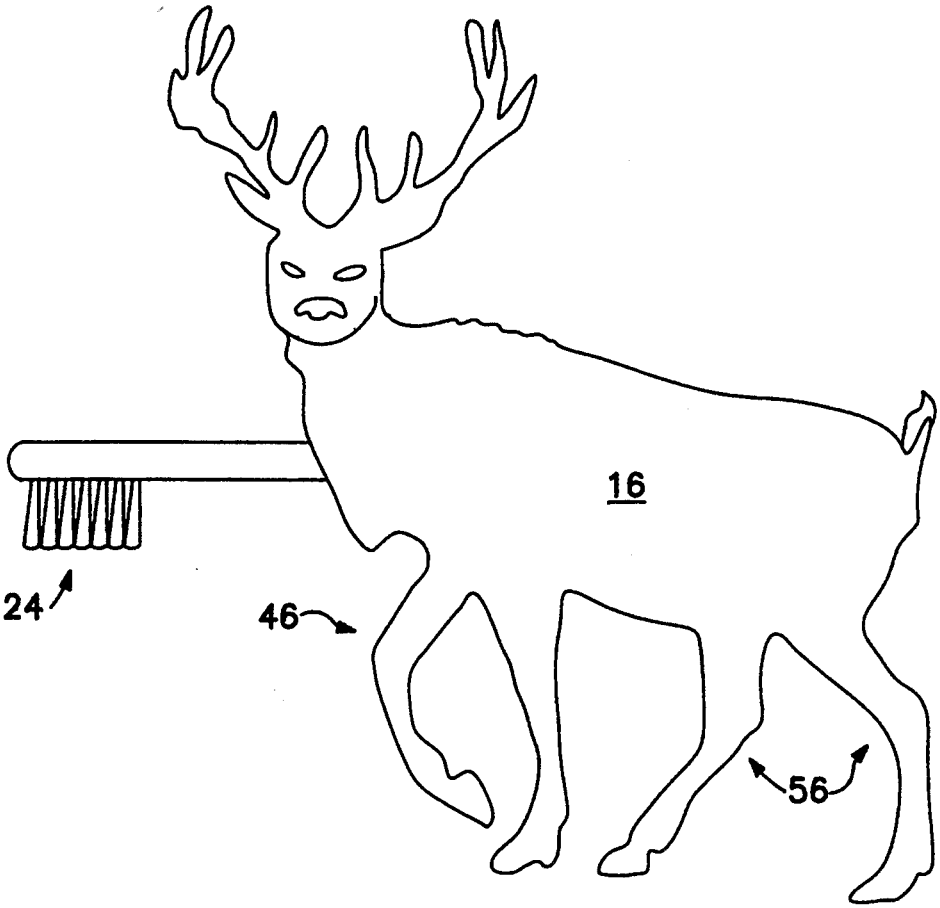
FIG. 10 is a side view of a typical toothbrush of this invention in which the animal is an elk.
Figure 11:
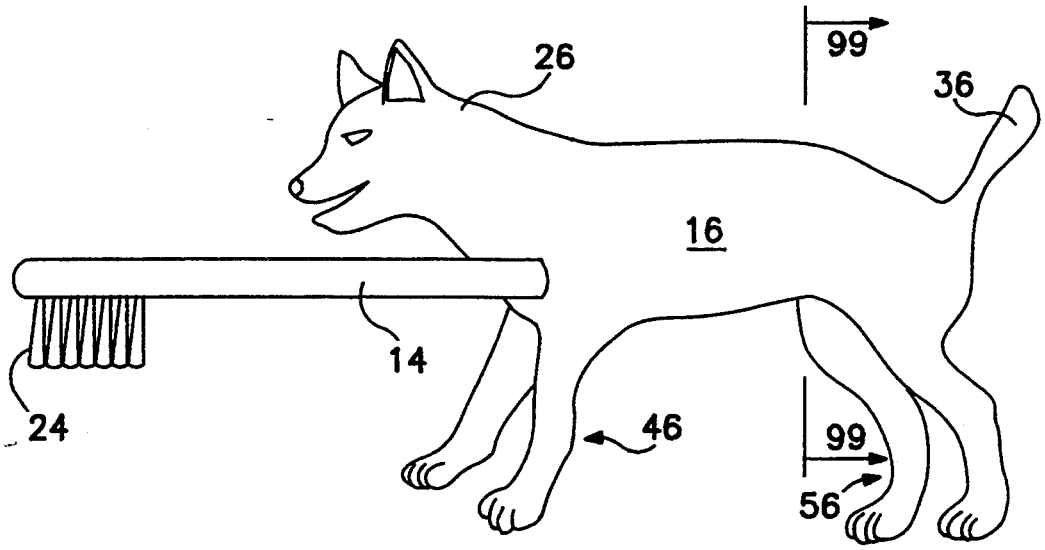
FIG. 11 is a side view of a typical toothbrush of this invention in which the animal is a wolf.
Figure 12:
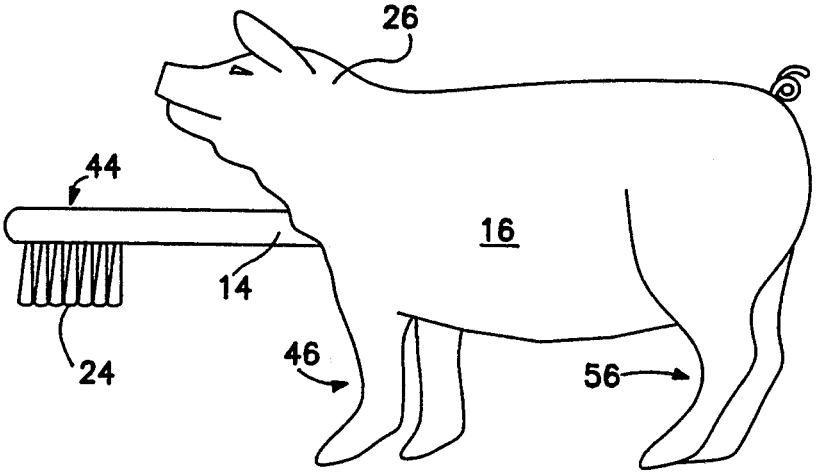
FIG. 12 is a side view of a typical toothbrush of this invention in which the animal is a pig.
Figure 13:
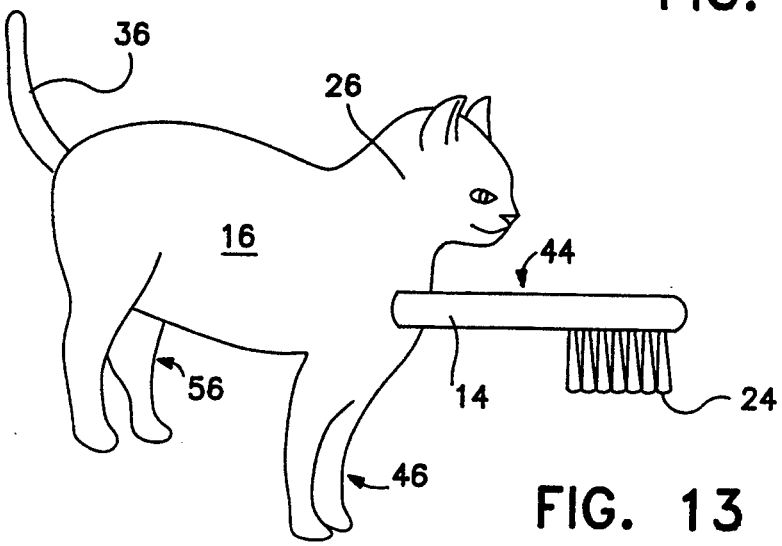
FIG. 13 is a side view of a typical toothbrush of this invention in which the animal is a cat.
Figure 14:
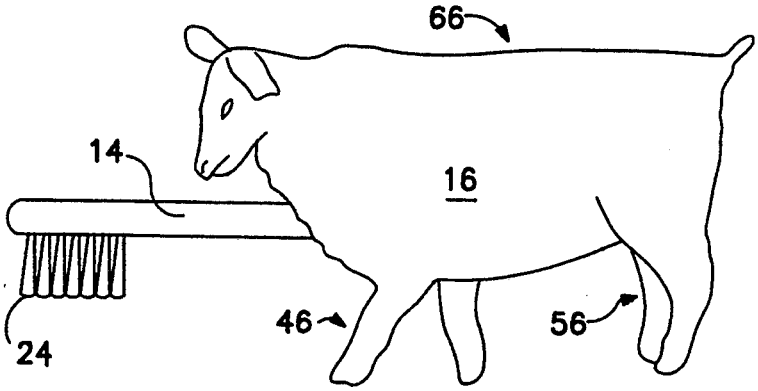
FIG. 14 is a side view of a typical toothbrush of this invention in which the animal is a sheep.

As FIGS. 4, 10 and 16 illustrate, all four legs of a quadruped need not be used as supports for the brush when not in use. In the case of FIGS. 4 and 10, three of the four limbs are used as such supports and in this case the overall construction is shaped and its weight is distributed such that the brush is readily balanced in a stable position on the three limbs resting on the underlying surface. The construction illustrated in FIG. 16 involves use of a pair of transversely disposed base plates 76,76 such that one front limb is connected to one base plate and one back limb is connected to the other base plate to thereby provide a stable balanced support for the construction when not in use.

Figure 19:
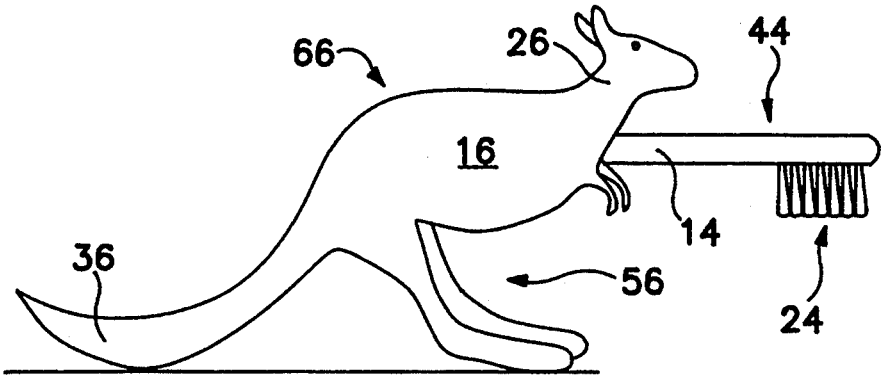
FIG. 19 is a side view of a typical toothbrush of this invention in which the animal is a kangaroo.
Figure 20:
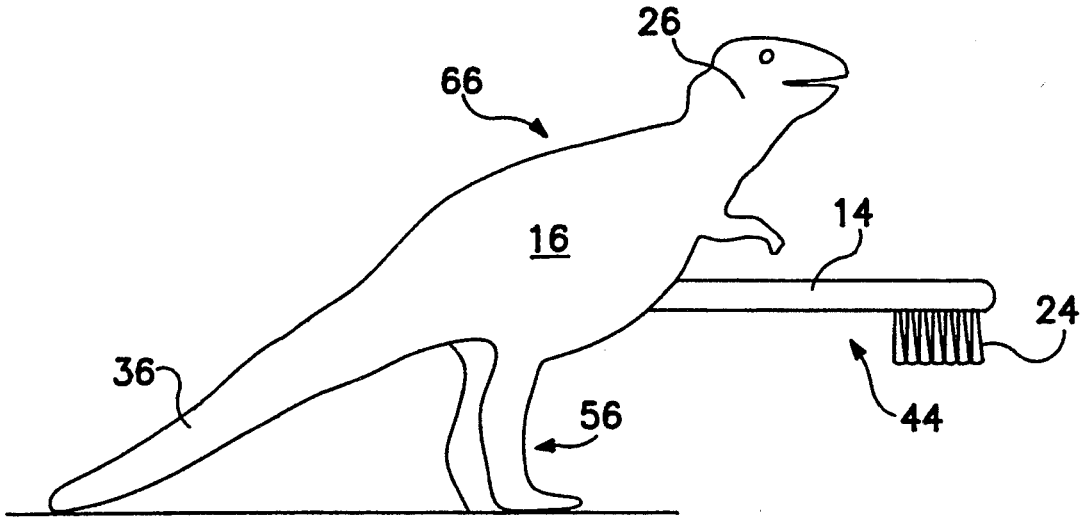
FIG. 20 is a side view of a typical toothbrush of this invention in which the animal is a dinosaur.
Figure 21:
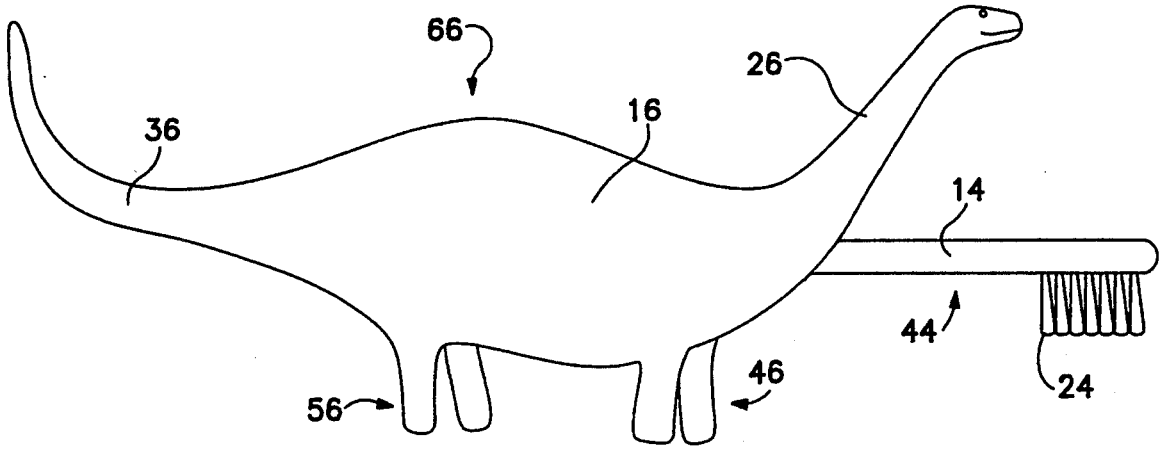
FIG. 21 is a side view of a typical toothbrush of this invention in which the animal is a dinosaur.

FIGS. 19 and 20 illustrate another variant which can be effectively utilized in the practice of this invention, namely the employment of the tail portion 36 and a leg portion composed of two laterally disposed limbs (usually rear leg portion 56) as the supports for the brush construction when not in use. Such construction serves as a tripod to provide such support for the brush on the underlying support.

Figure 18:
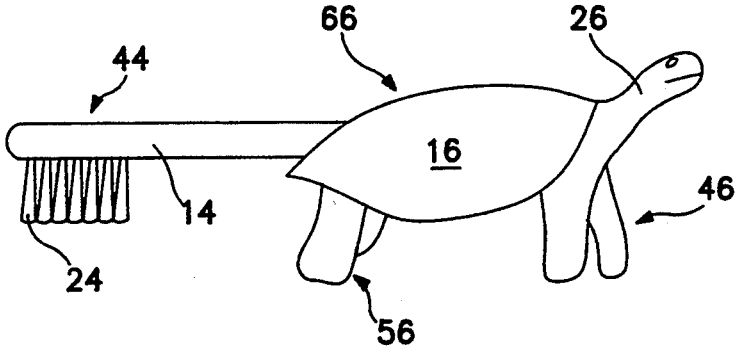
FIG. 18 is a side view of a typical toothbrush of this invention in which the animal is a turtle.

FIG. 17 illustrates a brush construction of this invention wherein two brush head portions 44,44 are employed, the stem of one projecting from the front end and the stem of the other projecting from the back end of body portion 16 of the animal embodied in the construction of handle portion 66. In the embodiment depicted in FIG. 18, the stem of brush head portion 44 projects from the back end of body portion 16 whereas in most of the other figures the stem projects from the front end of the body portion.

In preferred form, at least the circumference of body portion 16 is fabricated from a relatively rigid, slightly compressible foam or cellular material, preferably a closed cell plastic foam such as foamed EVA (ethylene-vinyl acetate), or like material characterized by having a relatively firm and relatively smooth outer finish, by being manually compressible or squeezable but resilient, and by being pleasant to the touch. From the production standpoint it is preferable to fabricate most, if not all, of handle portion 66 from such foam or cellular material.

Figure 22:
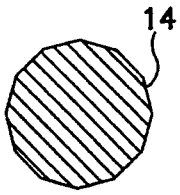
FIG. 22 is a cross-section of a preferred stem of the brush head portion of a toothbrush of this invention.
Figure 23:
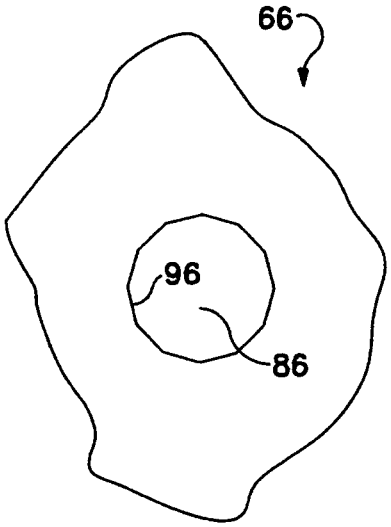
FIG. 23 is a front fragmental view of a preferred handle portion of a toothbrush of this invention.

As noted hereinabove, stem 14 of brush head portion 44 can be shaped to snugly fit into a matched recess or socket in handle portion 66 so that the entire brush head portion 44 is detachably attachable to the handle portion. One preferred way of accomplishing this is depicted in FIGS. 22 and 23. In the form depicted, stem 14 in FIG. 22 has a polygonal (in particular, a dodecagonal) shape in cross section. The fragment of handle portion 66 depicted in FIG. 23 has a matching recess or socket 86 defined by wall 96 which is likewise in polygonal form (in this case, dodecagonal form) so that recess 86 is adapted to snugly receive the stem 14. Such construction not only enables replacement of the brush head, but enables the user to orient the direction of the bristles relative to the handle portion by rotating the brush head to the desired orientation before inserting the stem into the matching recess or socket.

It will thus be appreciated that the devices of this invention can be adapted for use by right-handed persons or for left-handed persons simply by suitably altering the orientation of the brush head and bristles relative to the handle portion.

If desired, handle portion 66 can contain a hollowed-out compartment for storage of a detachably attachable brush head portion 44. Such compartment can be fitted with a suitable cover, plug or lid to encase the entire brush head portion within the handle portion. In this way the entire toothbrush can be transported in disassembled form from place to place in a sanitary condition, and with minimal risk that the user (especially a child) will lose the brush head portion during camping trips or like excursions. By fabricating the handle portion from a closed cell foam, by providing such hollowed out compartment encasing the disassembled brush head portion, and by providing a water-tight cover, plug or lid for the compartment, the entire device can be made buoyant enough to float, a feature which can prevent its loss in the event the device is accidentally dropped into a body of water for example during a canoe trip. And at the same time, the sanitary condition of the brush head can be maintained.

From the foregoing it can be seen that the invention can take the form of a considerable number of embodiments. A summary of some of these embodiments is set forth below:

I. A toothbrush construction which comprises:
- (a) a handle portion; and
- (b) a brush head portion having bristles extending at an angle therefrom, said toothbrush construction being further characterized in that:
- (c) said handle portion is in the general form of (i.e., it simulates) an animal and includes
  - (i) a generally horizontal body (trunk) portion (preferably, a substantially horizontal body portion) adapted to be manually encircled and grasped by the hand with the thumb extending under and around the lower part of the body portion and with the palm and fingers extending over and around the upper part of the body portion as in a fist,
  - (ii) a head/neck portion attached to said body portion,
  - (iii) a front leg portion attached to said body portion,
  - (iv) a rear leg portion attached to said body portion, and
  - (v) optionally, a tail portion attached to said body portion;
- (d) at least one of (ii) and (iii) extends outwardly relative to said body portion to form a first restraining member, and at least one of (iv) and (v) extends outwardly relative to said body portion to form a second restraining member spaced apart from the first restraining member;
- (e) said restraining members are disposed on said handle portion such that when said body portion is grasped as in a fist as hereinbefore described, one of said restraining members is adapted to be proximate or adjacent to the thumb and forefinger side of the hand of the user and the other of said restraining members is adapted to be proximate or adjacent to the fourth finger side of the hand of the user;
- (f) said brush head portion includes a stem which extends substantially longitudinally from an end of said handle portion; and
- (g) a portion of said handle portion is adapted to support the toothbrush, when not in use, on a flat supporting surface with the bristles of said brush head portion spaced from such supporting surface.

II. A construction as set forth in I. wherein said handle portion is in the general form of a quadrupedal animal.

III. A construction as set forth in I. wherein said handle portion is in the general form of a quadrupedal animal and wherein said portion of said handle portion adapted to support the toothbrush, when not in use, on a flat supporting surface is comprised of the four limbs of said quadrupedal animal in a generally downward disposition to thereby provide four individual supports for the construction on such supporting surface.

IV. A construction as set forth in I. wherein said handle portion includes a tail portion.

V. A construction as set forth in I. wherein said handle portion includes a tail portion and wherein said tail portion extends outwardly relative to said body portion to constitute at least one said second restraining member.

VI. A construction as set forth in I. wherein said handle portion is in the general form of a quadrupedal animal; wherein said handle portion includes a tail portion; and wherein said tail portion extends outwardly relative to said body portion to constitute at least one said second restraining member.

VII . A construction as set forth in I. wherein said handle portion is in the general form of a quadrupedal animal; wherein said handle portion includes a tail portion; wherein said tail portion extends outwardly relative to said body portion to constitute one said second restraining member; and wherein said rear leg portion of the quadrupedal animal constitutes another said second restraining member.

VIII. A construction as set forth in I. wherein said handle portion is in the general form of a quadrupedal animal and wherein said head/neck portion of the quadrupedal animal extends outwardly relative to said body portion to constitute at least one said first restraining member.

IX. A construction as set forth in I. wherein said handle portion is in the general form of a quadrupedal animal; wherein said head/neck portion of the quadrupedal animal extends outwardly relative to said body portion to constitute one said first restraining member; and wherein said front leg portion of the quadrupedal animal constitutes another said first restraining member.

X. A construction as set forth in I. wherein said handle portion is in the general form of a quadrupedal animal; wherein said head/neck portion of the quadrupedal animal extends outwardly relative to said body portion to constitute one said first restraining member; wherein said front leg portion of the quadrupedal animal constitutes another said first restraining member; wherein said handle portion includes a tail portion; wherein said tail portion extends outwardly relative to said body portion to constitute one said second restraining member; and wherein said rear leg portion of the quadrupedal animal constitutes another said second restraining member.

XI. A construction as set forth in X wherein said portion of said handle portion adapted to support the toothbrush, when not in use, on a flat supporting surface is comprised of the four limbs of said quadrupedal animal in a generally downward disposition to thereby provide four individual supports for the construction on such supporting surface.

XII . A construction as set forth in I. wherein said handle portion includes a downwardly extending tail portion and wherein said rear leg portion of the animal comprises a laterally disposed downwardly extending pair of limbs such that said portion of said handle portion adapted to support the toothbrush, when not in use, on a flat supporting surface is comprised of the downwardly extending pair of limbs and the downwardly extending tail portion to thereby provide three individual supports for the construction on such supporting surface, as in a tripod.

XIII. A construction as set forth in I. wherein the stem of said brush head portion extends substantially longitudinally from the forward end portion of said handle portion.

XIV. A construction as set forth in I. wherein the stem of said brush head portion extends substantially longitudinally from the rearward end portion of said handle portion.

XV. A construction as set forth in I. wherein the stem of one said brush head portion extends substantially longitudinally from the forward end portion of said handle portion and wherein the stem of another said brush head portion extends substantially longitudinally from the rearward end portion of said handle portion.

XVI. A construction as set forth in I. wherein at least one of said leg portions is configured in the form of fins, flippers. tentacles, claws or other body appendages.

XVII. A construction as set forth in I. wherein the stem of said brush head portion extends substantially horizontally from said handle portion.

XVIII. A toothbrush construction which comprises:

(a) a handle portion; and (b) a brush head portion having bristles extending at an angle therefrom, said toothbrush construction being further characterized in that:

(c) said handle portion is in the general form of (i.e., it simulates) a quadrupedal animal and includes (i) a generally horizontal body (trunk) portion adapted to be manually encircled and grasped by the hand with the thumb extending under and around the lower part of the body portion and with the palm and fingers extending over and around the upper part of the body portion as in a fist, (ii) a head/neck portion attached to said body portion with at least a portion of said head/neck portion extending generally upwardly relative to said body portion, (iii) a front leg portion consisting of a pair of legs attached to said body portion with at least a portion of said pair of legs extending generally downwardly relative to said body portion, (iv) a rear leg portion consisting of a pair of legs attached to said body portion with at least a portion of said pair of legs extending generally downwardly relative to said body portion, and (v) a tail portion attached to said body portion with at least a portion of said tail portion extending generally upwardly relative to said body portion;

(d) said head/neck portion and said front leg portion are disposed on said handle portion such that when said body portion is grasped as in a fist as hereinbefore described, at least part of said head/neck portion and at least part of said front leg portion are adapted to abut or be proximate either to the thumb and forefinger side of the hand of the user or to the fourth finger side of the hand of the user;

(e) said tail portion and said rear leg portion are disposed on said handle portion such that when said body portion is grasped as in a fist as hereinbefore described, at least part of said tail portion and at least part of said rear leg portion are adapted to abut or be proximate either to the thumb and forefinger side of the hand of the user or to the fourth finger side of the hand of the user, whichever is not abutted by or proximate to at least part of said head/neck portion and at least part of said front leg portion;

(f) said brush head portion includes a stem which extends substantially longitudinally from an end of said handle portion; and (g) said front leg portion and said rear leg portion are adapted to support the toothbrush, when not in use, on a flat supporting surface with the bristles of said brush head portion spaced from such supporting surface.

XIX. A construction as set forth in XVIII. wherein the stem of said brush head portion extends substantially horizontally from said handle portion.

XX. A construction as set forth in XVIII. wherein said brush head portion includes a stem and said handle portion includes a matching recess therein into which said stem can snugly fit such that said stem can be detachably attached to said handle portion with the brush head in a selected orientation relative to said handle portion.

XXI . A construction as set forth in any of I. through XX. inclusive wherein at least an exterior portion of that part of said body portion adapted to be manually encircled and grasped by the hand of the user with the thumb extending under and around the lower part of the body portion and with the palm and fingers extending over and around the upper part of the body portion as in a fist, is fabricated from a cellular material, preferably from a closed cell cellular polymer characterized by having a relatively firm and relatively smooth outer finish, by being manually squeezable but resilient, and by being pleasant to the touch, and most preferably, from a closed cell foamed or cellular ethylene-vinyl acetate copolymer.

XXII. A construction as set forth in any of I. through XX. inclusive wherein most, if not all, of the handle portion of the construction (including said body portion adapted to be manually encircled and grasped by the hand of the user with the thumb extending under and around the lower part of the body portion and with the palm and fingers extending over and around the upper part of the body portion as in a fist) is fabricated from a cellular material, preferably from a closed cell cellular polymer characterized by having a relatively firm and relatively smooth outer finish and by being manually compressible or squeezable but resilient, and most preferably, from a closed cell ethylene-vinyl acetate copolymer.

XXIII. A construction as set forth in any of I. through XX. inclusive wherein the entire handle portion of the construction (including said body portion adapted to be manually encircled and grasped by the hand of the user with the thumb extending under and around the lower part of the body portion and with the palm and fingers extending over and around the upper part of the body portion as in a fist) is fabricated from a cellular material, preferably from a closed cell cellular polymer characterized by having a relatively firm and relatively smooth or a textured outer finish (e.g., simulating an animal's hide) and by being manually compressible but resilient, and most preferably, from a closed cell ethylene-vinyl acetate copolymer.

Figure 24:
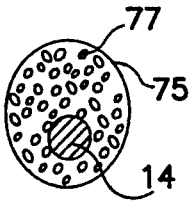
FIGS. 24 and 25 are sections taken along line 99,99 of FIG. 11 depicting alternative constructions.
Figure 25:
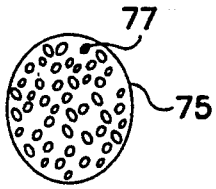

FIGS. 24 and 25 illustrate toothbrush constructions of this invention in which cellular material is used. FIG. 24 illustrates a body portion 16 in which cellular material 77 is disposed around the core of stem 14 (which may itself be fabricated from a solid plastic material) to form at least a substantial part of the body portion. Thus in FIG. 24, stem 14 extends deeply into body portion 16 and constitutes a core or reinforcement surrounded by cellular material of the type described above. In FIG. 25 body portion 16 is composed in cross section along a substantial part of its length entirely of cellular material 77. In this case stem 14 extends less deeply into body portion 16 than in FIG. 24. In FIGS. 24 and 25 the outer surface 75 of cellular material 77 is either smooth or textured, e.g., to simulate the skin or hide of the animal embodied in handle portion 66.

This invention is susceptible to considerable variation in its practice within the spirit and scope of the appended claims. Thus this invention is not intended to be limited by the specific exemplifications described hereinabove.

What is claimed is:

1. A toothbrush construction which comprises:

(a) a handle portion; and (b) a brush head portion having bristles extending at an angle therefrom, said toothbrush construction being further characterized in that:

(c) said handle portion is in the form simulating an animal and includes (i) body (trunk) portion which includes a lower part and an upper part, said body portion being sized and shaped to be manually encircled and grasped by the hand with the thumb extending under and around the lower part of the body portion and with the palm and fingers extending over and around the upper part of the body portion as in a fist, (ii) a head/neck portion attached to a first part of said body portion, (iii) a front leg portion attached to a second part of said body portion, and (iv) a rear leg portion attached to a third part of said body portion;

(d) said brush head portion is connected to and extends outwardly from a further part of said body portion;

(e) at least one of (ii) and (iii) extends outwardly generally transversely relative to said body portion to form a first restraining member, and (iv) extends outwardly generally transversely relative to said body portion to form a second restraining member spaced apart from the first restraining member;

(f) said front leg portion and said rear leg portion terminate below said respective second and third parts of said body portion from which said front leg portion and said rear leg portion extend, at a distance greater than any distance by which the lowest portion of said brush head portion may extend below said body portion;

(g) said restraining members are disposed on said handle portion such that when said body portion is grasped as in a fist as hereinbefore described, one of said restraining members is in a position to be proximate or adjacent to the thumb and forefinger side of the hand of the user and the other of said restraining members is in a position to be proximate or adjacent to the fourth finger side of the hand of the user;

(h) said brush head portion includes a stem which extends substantially longitudinally from an end of said handle portion;

(i) said front leg portion and said rear leg portion are shaped, sized and attached to said body portion so that so that said leg portions can support the toothbrush, when not in use, and when on a flat horizontal supporting surface with the bristles of said brush head portion remotely spaced from such supporting surface, with said body portion in a substantially horizontal position, and with said body portion spaced from said flat supporting surface by a sufficient distance to enable the hand of the user to encircle and grasp said body portion between said restraining members with the thumb of said hand extending under and around the lower part of said body portion and with the palm and fingers of said hand extending over and around the upper part of said body portion as in a fist; and (j) said first restraining member and said second restraining member each extends outwardly generally transversely relative to said body portion a sufficient distance to restrain the hand of the user against sliding over either of said restraining members while the hand of the user encircles and grasps said body portion between said restraining members with the thumb of said hand extending under and around the lower part of said body portion and with the palm and fingers of said hand extending over and around the upper part of said body portion as in a fist.

2. A construction as claimed in claim 1 wherein said front leg portion and said rear leg portion are both sized, shaped and positioned such that when the toothbrush is not in use, (i) said front leg portion and said rear leg portion elevate said body portion above said flat supporting surface to maintain said sufficient distance to enable the hand of the user to encircle and grasp said body portion between said restraining members with the thumb of said hand extending under and around the lower part of said body portion and with the palm and fingers of said hand extending over and around the upper part of said body portion as in a fist, and (ii) said front lea portion and said rear leg portion concurrently provide transverse support to restrain the toothbrush against lateral tipping or rolling as said body portion is being so encircled and grasped by said hand of the user; and wherein at least an exterior portion of that part of said body portion that is sized and shaped to be so manually encircled and grasped by said hand of the user is fabricated from a cellular material such that said exterior portion of said body portion and said first and second restraining members cooperate in restraining said hand of the user against sliding over either of said restraining members while the hand of the user so encircles and grasps said part of said body portion.

3. A construction as claimed in claim 2 wherein said cellular material is a closed cell cellular polymer.

4. A construction as claimed in claim 3 wherein said closed cell cellular polymer is characterized by having a relatively smooth outer finish and by being manually compressible but resilient.

5. A construction as claimed in claim 3 wherein said closed cell cellular polymer is selected the group consisting of a closed cell foamed and cellular ethylene-vinyl acetate copolymer.

6. A construction as claimed in claim 1 wherein said handle portion is in the general form of a quadrupedal animal; wherein said front leg portion and said rear leg portion are both sized, shaped and positioned such that when the toothbrush is not in use, (i) said front leg portion and said rear leg portion elevate said body portion above said flat supporting surface to maintain said sufficient distance to enable the hand of the user to encircle and grasp said body portion between said restraining members with the thumb of said hand extending under and around the lower part of said body portion and with the palm and fingers of said hand extending over and around the upper part of said body portion as in a fist, and (ii) said front leg portion and said rear leg portion concurrently provide transverse support to restrain the toothbrush against lateral tipping or rolling as said body portion is being so encircled and grasped by said hand of the user; and wherein at least an exterior portion of that part of said body portion that is sized and shaped to be so manually encircled and grasped by said hand of the user is fabricated from a cellular material having a relatively smooth outer finish such that said exterior portion of said body portion and said first and second restraining members cooperate in restraining said hand of the user against sliding over either of said restraining members while the hand of the user so encircles and grasps said part of said body portion.

7. A construction as claimed in claim 6 wherein said cellular material is a closed cell cellular polymer.

8. A construction as claimed in claim 7 wherein said closed cell cellular polymer is characterized by being manually compressible but resilient.

9. A construction as claimed in claim 7 wherein said closed cell cellular polymer is selected from the group consisting of a closed cell foamed and cellular ethylene-vinyl acetate copolymer.

10. A construction as claimed in claim 1 wherein said handle portion is in the general form of a quadrupedal animal; wherein said portion of said handle portion that is shaped, sized and in a location on said handle so that it can support the toothbrush, when not in use, on a flat supporting surface is comprised of the four limbs of said quadrupedal animal in a generally downward disposition to thereby (i) provide four individual supports for the construction on such supporting surface, (ii) constitute four said restraining members and (iii) define a space between such supporting surface and said lower part of said body portion; wherein the height of the space between such supporting surface and the lower part of the simulated animal is at least about 30 millimeters; wherein at least an exterior portion of that part of said body portion that is sized and shaped to be manually encircled and grasped by the hand of the user with the thumb extending under and around the lower part of the body portion and with the palm and fingers extending over and around the upper part of the body portion as in a fist, is fabricated from a closed cell cellular material; wherein said four individual supports are disposed laterally by a sufficient distance to restrain the toothbrush against lateral tipping or rolling as said body portion is being so encircled and grasped by said hand of the user; and wherein said four individual supports and said cellular material cooperate in restraining said hand of the user against inadvertently contacting said brush head portion, and in restraining said hand of the user against moving past any of said four individual supports while the hand of the user so encircles and grasps said body portion.

11. A construction as claimed in claim 10 wherein said handle portion includes a tail portion and wherein said tail portion extends outwardly generally transversely relative to said body portion to constitute another restraining member.

12. A construction as claimed in claim 10 wherein said head/neck portion of the quadrupedal animal extends outwardly generally transversely relative to said body portion to constitute at least one said first restraining member.

13. A construction as claimed in claim 10 wherein said head/neck portion of the quadrupedal animal extends outwardly generally transversely relative to said body portion to constitute one said first restraining member; and wherein said front leg portion of the quadrupedal animal constitutes another said first restraining member.

14. A construction as claimed in claim 10 wherein said head/neck portion of the quadrupedal animal extends outwardly generally transversely relative to said body portion to constitute one said first restraining member; wherein said front leg portion of the quadrupedal animal constitutes another said first restraining member; wherein said handle portion includes a tail portion; wherein said tail portion extends outwardly generally transversely relative to said body portion to constitute another restraining member;

15. A construction as claimed in claim 10 wherein said brush head portion extends substantially longitudinally from the forward end portion of said handle portion.

16. A construction as claimed in claim 10 wherein one said brush head portion extends substantially longitudinally from the forward end portion of said handle portion and wherein another said brush head portion extends substantially longitudinally from the rearward end portion of said handle portion.

17. A construction as claimed in claim 1 further comprising a tail portion attached to another part of said body portion and wherein said tail portion extends outwardly generally transversely relative to said body portion to form another restraining member spaced apart from the first restraining member.

18. A toothbrush construction which comprises:

(a) a handle portion; and (b) a brush head portion having bristles extending at an angle therefrom, said toothbrush construction being further characterized in that:

(c) said handle portion is in the form simulating an animal and includes (i) a substantially horizontal body (trunk) portion which includes a lower part and an upper part, said body portion being sized and shaped to be manually encircled and grasped by the hand with the thumb extending under and around the lower part of the body portion and with the palm and fingers extending over and around the upper part of the body portion as in a fist, (ii) a head/neck portion attached to a first part of said body portion with at least a portion of said head/neck portion extending generally upwardly relative to said body portion, (iii) a front leg portion consisting of a pair of legs attached to a second part of said body portion with at least a portion of said pair of legs extending generally downwardly relative to said body portion, (iv) a rear leg portion consisting of a pair of legs attached to a third part of said body portion with at least a portion of said pair of legs extending generally downwardly relative to said body portion, and (v) a tail portion attached to a fourth part of said body portion with at least a portion of said tail portion extending generally upwardly relative to said body portion;

(d) said head/neck portion and said front leg portion are disposed on said handle portion such that when said body portion is grasped as in a fist as hereinbefore described, at least part of said head/neck portion and at least part of said front leg portion are in position to abut or be proximate either to the thumb and forefinger side of the hand of the user or to the fourth finger side of the hand of the user;

(e) said tail portion and said rear leg portion are disposed on said handle portion such that when said body portion is grasped as in a fist as hereinbefore described, at least part of said tail portion and at least part of said rear leg portion are in position to abut or be proximate either to the thumb and forefinger side of the hand of the user or to the fourth finger side of the hand of the user, whichever is not abutted by or proximate to at least part of said head/neck portion and at least part of said front leg portion;

(f) said brush head portion includes a stem which extends substantially longitudinally from a further part of said body portion;

(g) said front leg portion and said rear leg portion terminate below said respective parts of said body portion from which said front leg portion and said rear leg portion extend, at a distance greater than any distance by which the lowest portion of said brush head portion may extend below said body portion;

(h) said front leg portion and said rear leg portion are shaped, sized and in spaced apart locations on said handle portion so that said front leg portion and said rear leg portion can support the toothbrush, when not in use, on a flat supporting surface such that (i) there is a space between such supporting surface and the lower part of said body portion of at least about 30 millimeters in height to enable the user to insert the thumb into this space with the fingers of the same hand extending over and around the upper part of the body, and (ii) the bristles of said brush head portion are spaced from such supporting surface by a distance of at least about 35 millimeters;

(i) said head/neck portion is peripherally between said upper part of said body portion and said brush head portion to restrain the user's hand against sliding from said upper part of said body portion and inadvertently contacting said brush head portion;

(j) at least an exterior portion of that part of said body portion that is sized and shaped to be grasped as in a fist as hereinbefore described, is fabricated from a compressible, resilient closed cell cellular polymeric material such that (i) said exterior portion of said body portion, (ii) at least one of said front leg portion and said rear leg portion and (iii) said head/neck portion mutually cooperate in preventing the user's hand from sliding from said body portion and inadvertently contacting said brush head portion at any time while the body portion is so grasped.

19. A construction as claimed in claim 18 wherein said front leg portion and said rear leg portion are sized, shaped and positioned to support the toothbrush, when not in use on a flat supporting surface such that said stem is substantially horizontal and said brush head portion is spaced from the underlying supporting surface by a distance in the range of about 40 to about 75 millimeters; and wherein said cellular material is a closed cell ethylene-vinyl acetate foam.

20. A construction as claimed in claim 19 wherein said handle portion includes a matching recess therein into which said stem can snugly fit such that said stem can be detachably attached to said handle portion with the brush head and bristles in a selected orientation relative to said handle portion.

* * * * *